United States Patent [19]

Jones

[11] 4,383,478

[45] May 17, 1983

[54] RAIN CAP WITH PIVOT SUPPORT MEANS

[75] Inventor: W. Richard Jones, North Barrington, Ill.

[73] Assignee: Mercury Metal Products, Inc., Schaumburg, Ill.

[21] Appl. No.: 287,885

[22] Filed: Jul. 29, 1981

[51] Int. Cl.[3] ..... F23L 17/02

[52] U.S. Cl. ..... 98/59; 16/273; 29/434

[58] Field of Search ..... 98/59, 122; 16/273; 29/11, 434

[56] References Cited

U.S. PATENT DOCUMENTS

| | | | |
|---|---|---|---|
| 1,987,415 | 1/1935 | Padgett | 29/434 |
| 2,078,076 | 4/1937 | Hines | 16/273 X |
| 2,895,033 | 7/1959 | Favre | 16/273 X |
| 2,983,216 | 5/1961 | Stade et al. | 98/59 |
| 4,059,045 | 11/1977 | McClain | 98/122 |
| 4,255,928 | 3/1981 | Jones et al. | 98/59 X |

*Primary Examiner*—William E. Wayner
*Assistant Examiner*—Harold Joyce
*Attorney, Agent, or Firm*—Ralph R. Rath

[57] ABSTRACT

A pivotal connection between a gravity-actuated protective cover and a bracket structure for supporting the cover device on an exhaust conduit includes a center spacer that has a chrome hardened peripheral surface and is held between a pair of ears of the bracket by a conventional screw. A bearing sleeve or bushing encircles the spacer and is secured to the protective cover and has at least an internal surface permanently impregnated with a lubricant.

3 Claims, 6 Drawing Figures

RAIN CAP WITH PIVOT SUPPORT MEANS

DESCRIPTION

1. Technical Field

This invention relates generally to engine exhaust covers and, more particularly, to a rain cap structure of the type disclosed in U.S. Pat. Nos. 2,983,216 and 4,059,045, assigned to the Assignee of the present invention and incorporated herein by reference.

2. Background Prior Art

The use of gravity-actuated protective cover assemblies for upstanding exhaust conduits of internal combustion engines has been known for a number of years. The cover members are adapted to seat on the open end of the conduit whenever the engine is inoperative to prevent contaminates from being deposited therein. The gravity-actuated cover members have found a remarkable degree of commercial acceptance and are utilized almost universally on larger field vehicles, such as crawler tractors, industrial equipment and agricultural equipment.

One of the most crucial components of the gravity-actuated cover assembly of the type disclosed in the above-mentioned patents is the pivotal connection between the bracket which surrounds the conduit and the cover member. It has been determined that the service lift of a conventional well-known pivot support means between the cover assembly and the bracket structure, manufactured by the Assignee of the present invention, is only a few hundred hours of use. As can be appreciated, the cover assemblies are usually associated with large, relatively expensive equipment, such as a crawler tractor which may cost in excess of $100,000. In such instances, it is highly undesirable to have a relatively inexpensive component require replacement after only a few hundred hours of operating time.

Thus, a need has been developed for an improved type of pivotal connection between the bracket structure and the cover member of a gravity-actuated rain cap which will increase the service life of the unit.

SUMMARY OF THE INVENTION

According to the present invention, after extensive research and development, a unique combination of elements for the pivotal support means between the gravity-actuated cover assembly and the bracket support structure has been developed which can increase the service life to several thousand hours of use without any significant wear on the interconnection. The improved support means is interposed between a looped band portion encircling an exhaust conduit and having spaced ears on which the cover member and balance arm are pivotally supported through the pivot support means. The pivot support means consists of a spacer between the ears with fastener means securing the spacer and a sleeve carried by the cover member and balance arm and rotatable on the spacer. The spacer has a hardened chrome peripheral surface having a thickness of at least 0.0002 inches, while the sleeve has a permanent impregnated lubricant on the inner surface in engagement with the peripheral surface of the spacer to substantially expand the service life of the support means.

According to the method aspect of the present invention, the pivot support means is formed by producing a tubular spacer of predetermined length, cleaning the spacer and placing said clean spacer in a chrome bath to electroplate at least a peripheral surface to a minimum thickness of 0.0002 inches. A sleeve is then produced from a sintered iron material and having a length less than the length of the spacer and is placed in a vacuum cylinder containing a lubricant to impregnate the surface with the lubricant. The sleeve is then attached to the cover member and the spacer is telescoped into the sleeve and attached to the surrounding support bracket on the exhaust conduit.

Actual tests have shown that the life of the pivot support means constructed in accordance with the present invention has increased the life of the joint by as much as ten times.

BRIEF DESCRIPTION OF SEVERAL VIEWS OF DRAWINGS

DETAILED DESCRIPTION

Figure 1:
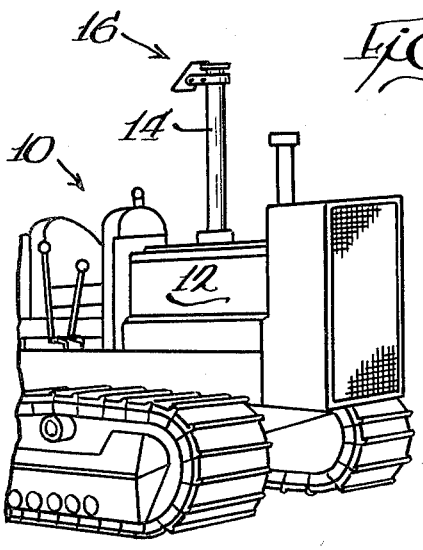
FIG. 1 is a fragmentary perspective view of a vehicle having the protective cover assembly on the exhaust conduit.
Figure 2:
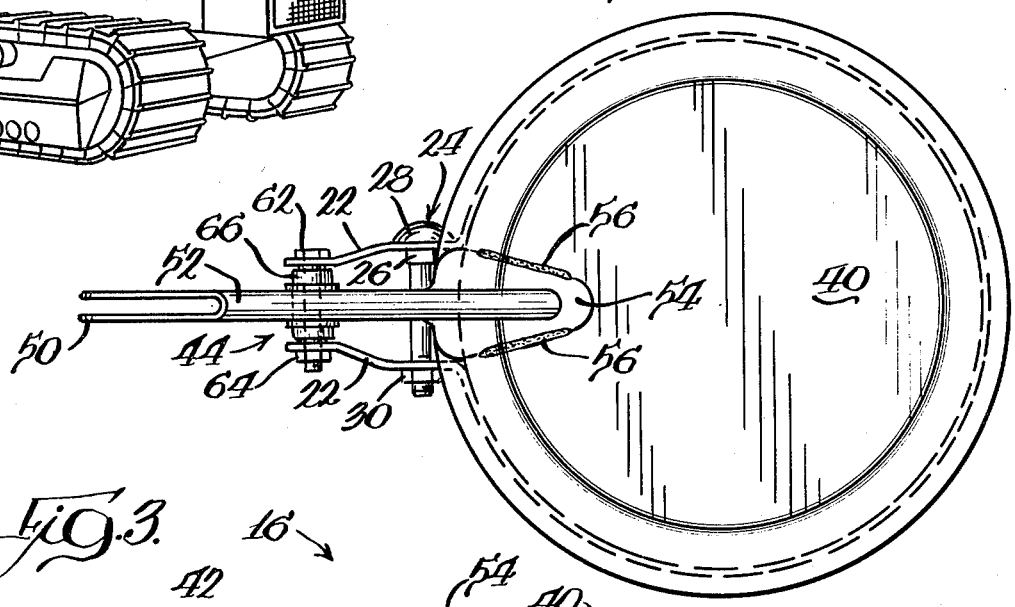
FIG. 2 is a top plane view of the assembly.
Figure 3:
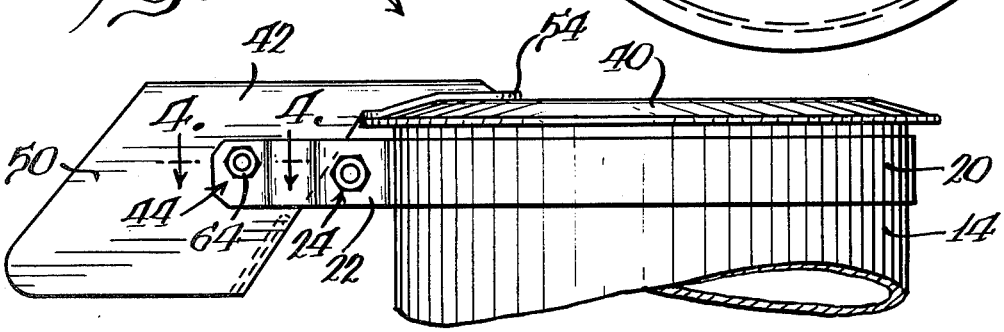
FIG. 3 is a side elevational view of the protective cover assembly.

While this invention is susceptible of embodiment in many different forms, there is shown in the drawings and will herein be described in detail a preferred embodiment of the invention with the understanding that the present disclosure is to be considerd as an exemplification of the principles of the invention and is not intended to limit the invention to the embodiment illustrated.

FIG. 1 of the drawings discloses a vehicle generally designated by reference numeral 10, such as a crawler tractor, having an engine 12 and an exhaust conduit 14 with the protective cover device or assembly 16 supported at the upper open end thereof. As indicated above, the majority of the construction of the protective cover assembly 16 is disclosed in U.S. Pat. No. 4,059,045, but will be repeated here for purposes of clarity.

The gravity-actuated protective cover device 16 includes a generally circular band or bracket 20 that is adapted to encompass or encircle conduit 14 at the upper end thereof and has a pair of ears 22 at the free ends thereof. Fastener means 24 extend through openings (not shown) adjacent the inner ends of ears 22 to securely hold the circular band or bracket in frictional engagement with the peripheral surface of exhaust conduit 14. In the specific embodiment illustrated, the fastening means is in the form of a carriage bolt having a rectangular segment 26 adjacent head 28 which cooperates with the rectangular opening in one ear 22 to prevent rotation of the bolt. A nut 30 is threaded onto the opposite end of the carriage bolt and can be tightened to the desired tension to maintain the band or bracket 20 on the exhaust conduit 16.

A cover member 40, preferably formed from a stainless steel material, is secured to a balance arm 42 which in turn is pivotally supported on ears 22 by a pivot support means 44 which will be described in more detail later.

The balance arm is preferably in the form of a stainless steel extruded member which includes a pair of polygonal plates 50 which have an integral connection 52 along one, preferably the upper, lateral edge. A generally triangular securing member 54 is integral with one end of the balance arm 42 and overlaps the cover member 40, being secured thereto by continuous arc wells 56 locared along opposite sides of the securing member.

The structure so far described is generally disclosed in the above-mentioned patents and the pivot point for the cover member and balance arm is such that the center of gravity for these two elements is located towards the conduit side of pivot point 44 so that the cover will close by gravity forces when no external forces are applied to the cover member. However, when exhaust fumes are exiting from the exhaust conduit 16, the cover member will be held open by the forces developed from the pressure of the exhaust fumes.

Figure 4:
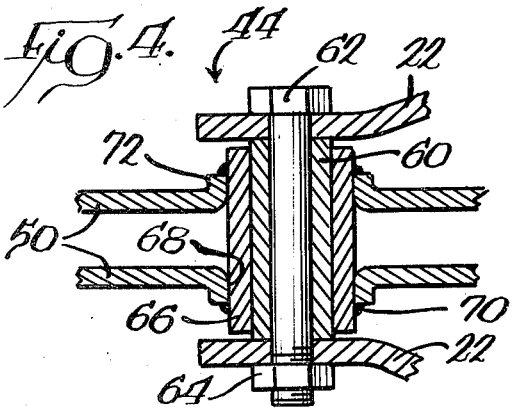
FIG. 4 is a cross-sectional view as viewed along line 4—4 of FIG. 3.

Referring to FIG. 4, the pivot support means 44 includes a spacer member or bearing support 60 that is held in a fixed position between ears 22 by a bolt 62 and a nut 64. A bearing sleeve 66 is secured within aperatures 68 in plates 50 by suitable welds 70, and preferably the plates have outwardly-directed flanges 72 which are extruded outwardly from plates 50.

Figure 5:
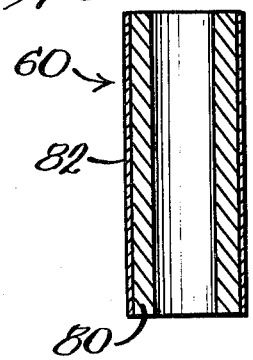
FIG. 5 is an enlarged cross-sectional view of one of the components of the pivot support constructed in accordance with the present invention; and, FIG. 6 is a cross-sectional view of the second component of the pivot support constructed in accordance with the present invention.
Figure 6:
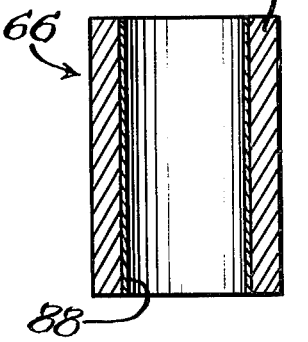

According to the present invention, the spacer 60 and bearing sleeve or bushing 66 are formed from specially selected materials that will substantially increase the service life of the pivot support means 44. More specifically, as illustrated in FIG. 5, the spacer 60 consists of a core of metallic material 80 which has an outer coating of hardened chrome 82. The bushing or sleeve 66 illustrated in FIG. 6 consists of a center core of hardened sintered iron 86 that has at least its inner surface area 88 impregnated with a permanent lubricant.

In forming the spacer 60, the center metallic core 80 is first passed through a cleaning bath to thoroughly cleanse any impurities from the surfaces and then is rinsed to remove any of the cleaning materials therefrom. The metallic bushing 80 is then immersed in a chromic acid solution and is made cathodic while the anode of an electric circuit is placed in contact with the chromic acid solution so that a current passes through the solution to complete the circuit and, as a result, the chrome metal in the solution is deposited upon the metallic core 80.

According to another aspect of the invention, the thickness of the coating layer 82 of hardened chrome is preferably applied to a minimum of 0.0002 inches and, more specifically, is normally coated to a thickness equivalent of approximately 0.0005 inches.

The luberized bushing of the present invention is formed by first sizing and cleaning the sintered iron core or bushing and then placing the bushing in a cylinder containing a lubricant, such as a Shell No. 68 Turbo Oil, or an equivalent thereof. Vacuum is then applied to the cylinder to produce a negative pressure to impregnate the surface of the core. The resultant structure is a sintered iron core that has its peripheral and internal surfaces permanently impregnated with a lubricant.

Extensive tests have shown that the unique interaction between the chrome hardened peripheral surface of spacer 60 and the permanently lubricated internal surface of the bushing or sleeve 66 produces a synergistic interaction which substantially increases the service life of the pivot means or pivotal support between the cover member and the bracket. A rain cap having the pivotal support means constructed in accordance with the present invention was installed on a crawler tractor having an exhaust conduit of approximately six inches in diameter and was placed in the field for extensive testing. After approximately 2,500 hours of operating time, spanning a period of several years, the subject rain cap was removed and returned to the laboratory for inspection and analysis. The inspection revealed that there was no significant wear on either the spacer or the bushing and the service life of the pivotal support had not been exhausted after all of the hours of operation.

Comparing this analysis with the prior experience of the Assignee of the present invention, utilizing conventional bearing materials, a service life of the pivotal support means constructed in accordance with the teachings of the present invention is believed to be tenfold when compared to the service life of the bearing structures that are now utilized commercially for the gravity-actuated covers.

I claim:

1. In a gravity-actuated protective cover device adapted to be secured to an upstanding exhaust conduit of an engine open at its upper end to prevent entry of undesirable material during inoperative stages of said engine, said cover member including a looped band portion encircling said conduit and having spaced ears on opposite ends with tightening means extending through said ears to secure said looped band on said exhaust conduit, a cover member and balance arm supported on said ears, and pivot support means pivotally supporting said cover member and balance arm between said ears, the improvement of said pivot support means comprising a spacer between said ears, fastener means securing said spacer between said ears, and a sleeve carried by said cover member and balance arm and rotatable on said spacer, said spacer having a hardened chrome peripheral surface, and said sleeve having a permanent lubricant impregnated inner surface in engagement with said peripheral surface to extend the service life of said pivot support means.

2. A protective cover device as defined in claim 1 in which said spacer has a metallic base with a hardened chrome peripheral layer having a minimum thickness of 0.0002 inches.

3. A protective cover device as defined in claim 1 in which said sleeve is a sintered iron material.

* * * * *